United States Patent [19]

Hurtz et al.

[11] 4,396,072

[45] Aug. 2, 1983

[54] METHOD AND APPARATUS FOR PRODUCING A DRILL HOLE

[75] Inventors: Georg Hurtz; Willi Steufmehl, both of Erkelenz, Fed. Rep. of Germany

[73] Assignee: Wirth Maschinen- und Bohrgerate-Fabrik GmbH, Erkelenz, Fed. Rep. of Germany

[21] Appl. No.: 242,262

[22] Filed: Mar. 10, 1981

[30] Foreign Application Priority Data

Mar. 25, 1980 [DE] Fed. Rep. of Germany ..... 3011449

[51] Int. Cl.[3] ..... E21B 3/02

[52] U.S. Cl. ..... 175/57; 175/94; 299/31

[58] Field of Search ..... 175/57, 94, 230, 122, 175/162, 53; 299/10, 18, 31

[56] References Cited

U.S. PATENT DOCUMENTS

| | | | |
|---|---|---|---|
| 3,180,437 | 4/1965 | Kellner et al. | 175/94 X |
| 3,225,843 | 12/1965 | Ortloff et al. | 175/94 X |
| 3,604,754 | 9/1971 | Kampf-Emden | 299/31 X |
| 3,830,318 | 8/1974 | Busby et al. | 175/122 |
| 4,095,655 | 6/1978 | Still | 175/94 X |
| 4,179,001 | 12/1979 | Still et al. | 175/57 |
| 4,274,675 | 6/1981 | Pavrat et al. | 299/31 |

*Primary Examiner*—Ernest R. Purser
*Attorney, Agent, or Firm*—Holman & Stern

[57] ABSTRACT

Producing a vertical or inclined drill hole by full profile drilling taking place upwardly from a starting location and utilizing a rotatable and displaceable drilling tool and a train of drilling rods which lead to the drilling tool, wherein the drilling tool is, together with the train of drilling rods, subjected, in the vicinity of the upper end of the train of drilling rods, to a force applied in the feed direction, at least part of the reaction of this force being transmitted to a counterabutment which can be releasably secured in the drill hole, and the driving torque for the drilling tool being produced at the starting location and mechanically led from there to the drilling tool.

19 Claims, 6 Drawing Figures

METHOD AND APPARATUS FOR PRODUCING A DRILL HOLE

BACKGROUND OF THE INVENTION

1. Field of the Invention

The present invention relates to a method of and to an apparatus for producing a vertical or inclined drill hole in a mine, a deposit or the like, by full profile drilling which takes place upwardly and from a roadway, a starting chamber or the like utilizing a rotatable and advancable drilling tool and a train of drilling rods leading to this drilling tool.

2. Description of the Prior Art

It is frequently found to be desirable or necessary to drill from a starting chamber, upwardly into solid material, e.g. because local conditions or requirements imposed by the operating procedures do not permit a drill hole to be produced downwardly or do not permit a pilot hole, passing to the target area, to be initially formed (this pilot hole being susceptible of widening later). However, the upward formation of a full drilling is accompanied by considerable difficulties and presents problems both in respect of the working procedures employed and also in respect of the drilling equipment used.

It is known to provide, at the upper end of a nonrotating train of drilling rods, a drilling head with which an electrical rotary drive is directly associated. Because this driving motor functions in the drilling hole and moves with the drilling head, an electrical energy supply line must be provided which leads from the starting chamber and passes, through the drill hole, to the drilling head. This means that sensitive parts, which are of high value, lie, with the drive motor and its supply means, in the drill hole. If a drill hole has to be abandoned due to breakage of the drilling rod train, a mine cave in, or due to other influences, not only will the drilling head be lost, but with it the valuable driving means. In the case of an apparatus of this kind the feed movement is produced in the starting chamber and must be transmitted to the drilling head through the train of drilling rods. Accordingly, the drilling rod train is loaded by the whole feeding force and in this way is subject to a high degree of buckling stress. This means that a heavy drilling rod train is needed, and also a relatively large number of stabilizers have to be used.

It is also known to produce both the feed for advancing movement and the torque for the drilling head in the starting chamber. A raisable rotary table is provided for this purpose. Both movements must then be transmitted to the drilling head by means of the train of drilling rods. The train of drilling rods is, accordingly, not only subject to buckling stress but also to rotary stress. By reason of the combination of rotation with simultaneous compressional stress alternating bending stresses are experienced.

BRIEF SUMMARY OF THE INVENTION

It is an object of the present invention to overcome or at least mitigate the above-mentioned difficulties, drawbacks and inadequacies of the prior art, and provide an improved method of producing a vertical or inclined drill hole by upward, full drilling. The invention also aims to provide an improved form of apparatus for producing a drilling of this kind.

The present invention in one aspect provides a method of producing a vertical or inclined drill hole by full profile drilling taking place upwardly from a starting location and utilizing a rotatable and displaceable drilling tool and a train of drilling rods which lead to the said drilling tool, wherein the drilling tool is, together with the train of drilling rods, subjected, in the vicinity of the upper end of the train of drilling rods, to a force applied in the feed direction, at least part of the reaction of the said force being transmitted to a counterabutment which can be releasably secured in the drill hole, and the driving torque for the drilling tool being produced at the starting location and mechanically led from there to the drilling tool.

Thus there may be produced by means of the invention a vertical or inclined drill hole in a mine, a deposit or the like, by drilling upwardly from a roadway, a starting chamber or the like.

When this method is employed no expensive and sensitive motors for the rotary drive of the drilling tool are needed in the drill hole, and also the axial loading of the train of drilling rods is reduced, so that there is no danger of buckling; also, the use of stabilizers may be reduced or may be rendered completely unnecessary. A further advantage is that screw-threaded rods which are at least normal in a wide measure, may be used; a screw-threaded train of rods can be readily and simply manipulated. Furthermore, the train of drilling rods may be relatively light, and also it may be possible to keep it of relatively small diameter.

Preferably, the condition of movement and/or the condition of loading of the train of drilling rods is at least temporarily affected by the application of force to the lower end of the train of drilling rods. This may be realized in a large number of ways according to particular requirements, and includes the application of force in the direction of the train of drilling rods both upwardly and downwardly, and also the securing of the lower end of the drilling rod train when force is to be applied to this train at some other point or when the drilling rod train is to remain in its rest condition. In this way favourable working conditions and favourable loading or stressing conditions can be attained in conjunction with force applied to the upper end of the train of drilling rods or force which is applied from the outside, these favourable conditions being experienced under a very widely differing range of practical drilling applications.

In particular, particularly during drilling, an upwardly directed torque may be suitably applied to the lower end of the train of drilling rods, the magnitude of this force corresponding to part of the downwardly directed force produced by the weight of the train of drilling rods and the parts moving with the train of rods, while the remaining part of the downwardly directed force is compensated for by the force applied to the upper end of the train of drilling rods. For example, a proportion of two thirds or three quarters of the weight of the train of drilling rods, with drilling tool and accessory parts, can be sustained in the lower area, and the remaining proportion can be sustained in the upper area, as a result of which the train of drilling rods can be held subject to a tensional loading or stress of a desired magnitude; in many instances this will be found to be particularly satisfactory.

According to a further modification of the method according to the invention, the counterabutment may be releasably secured, and force applied, in the feed direction, to the train of drilling rods in the vicinity of the upper end of the latter, due in common to a medium which is inwardly fed, from the starting location, by way of a single ducting path. This has, inter alia, the advantage of simplicity, and at the same time creates conditions under which favourable operation may be realized.

The counterabutment may be suitably released when the rotation of the drilling rod ends or is interrupted.

The invention in another aspect provides apparatus for producing a vertical or inclined drill hole by full profile drilling taking place upwardly from a starting location, comprising a basic unit to be arranged at the starting location, a drilling head, a rotary drive for the drilling head, a device for producing a force in the feed direction, and a train of drilling rods which lies between the drilling head and the basic unit, a supporting body connected to a bearing housing for the drilling head, through which supporting body passes an element for transmitting torque from the train of drilling rods, which can be rotated by a drive associated with the basic unit, to the drilling head, a slide which is non-rotatable relative to the supporting body but is guided so as to be axially displaceable by a clamping unit which is arranged on the slide and which has means actuatable by a fluid pressure medium and can be brought into a position of abutment against the wall of the drill hole, and feed cylinders which are connected both to the said bearing housing of the drilling head and also to the said slide and contain pistons which can be acted on, by fluid pressure medium, on both of their faces.

The advantages referred to in the course of the above description of the method according to the invention are also applicable to the apparatus according to the invention and its embodiments; however, the invention includes, within its ambit, other favourable features.

The method and apparatus according to the invention can be used with advantage in, for example, the fields of mining and tunnelling technology, and for other technological applications, in which vertical or inclined drill holes are to be formed.

BRIEF DESCRIPTION OF THE DRAWINGS

The invention will be further described, by way of example only, with reference to the accompanying drawings, in which.

DETAILED DESCRIPTION

Figure 1:
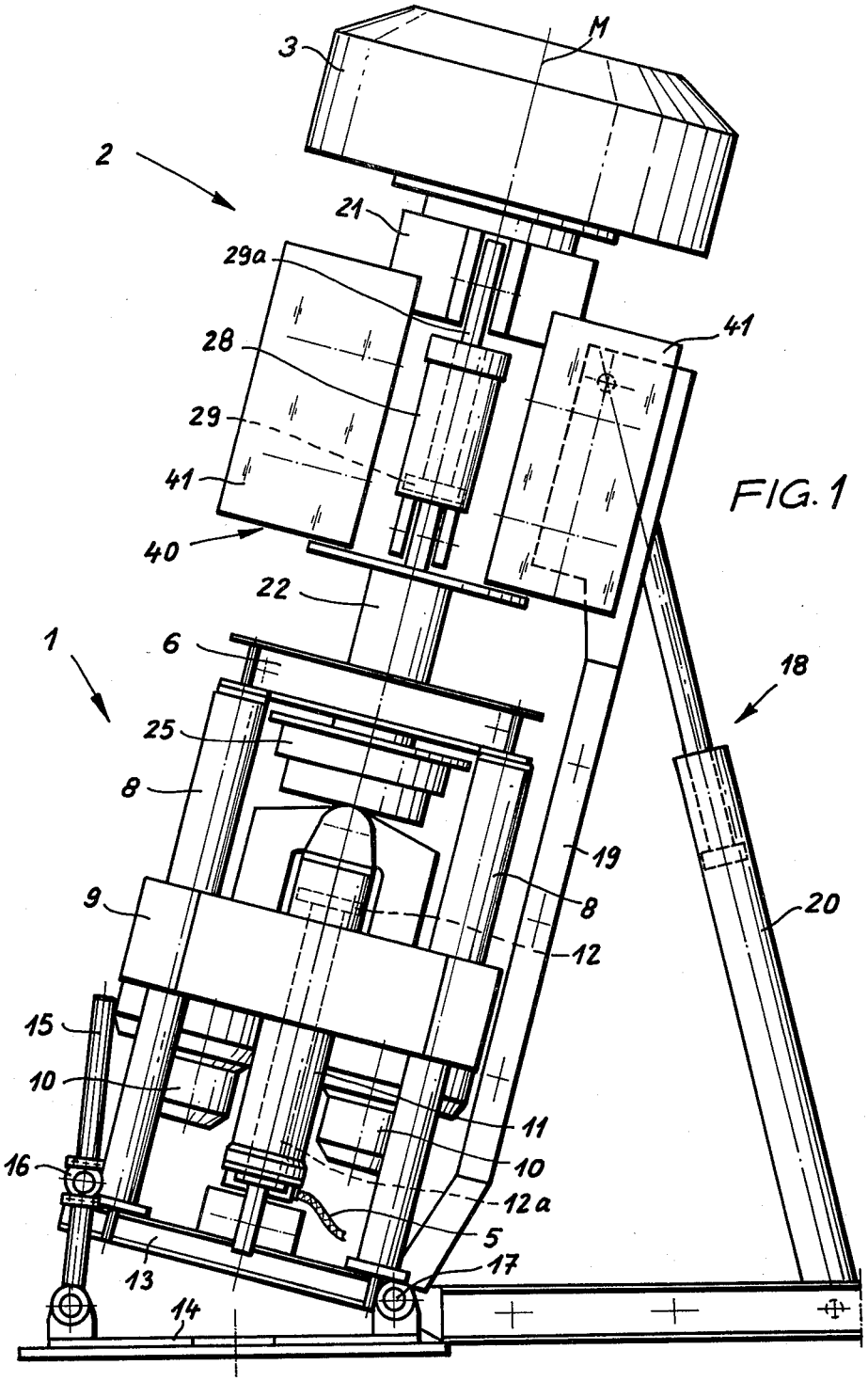
FIG. 1 is an elevational view of an assembled embodiment of the apparatus according to the invention.
Figure 2:
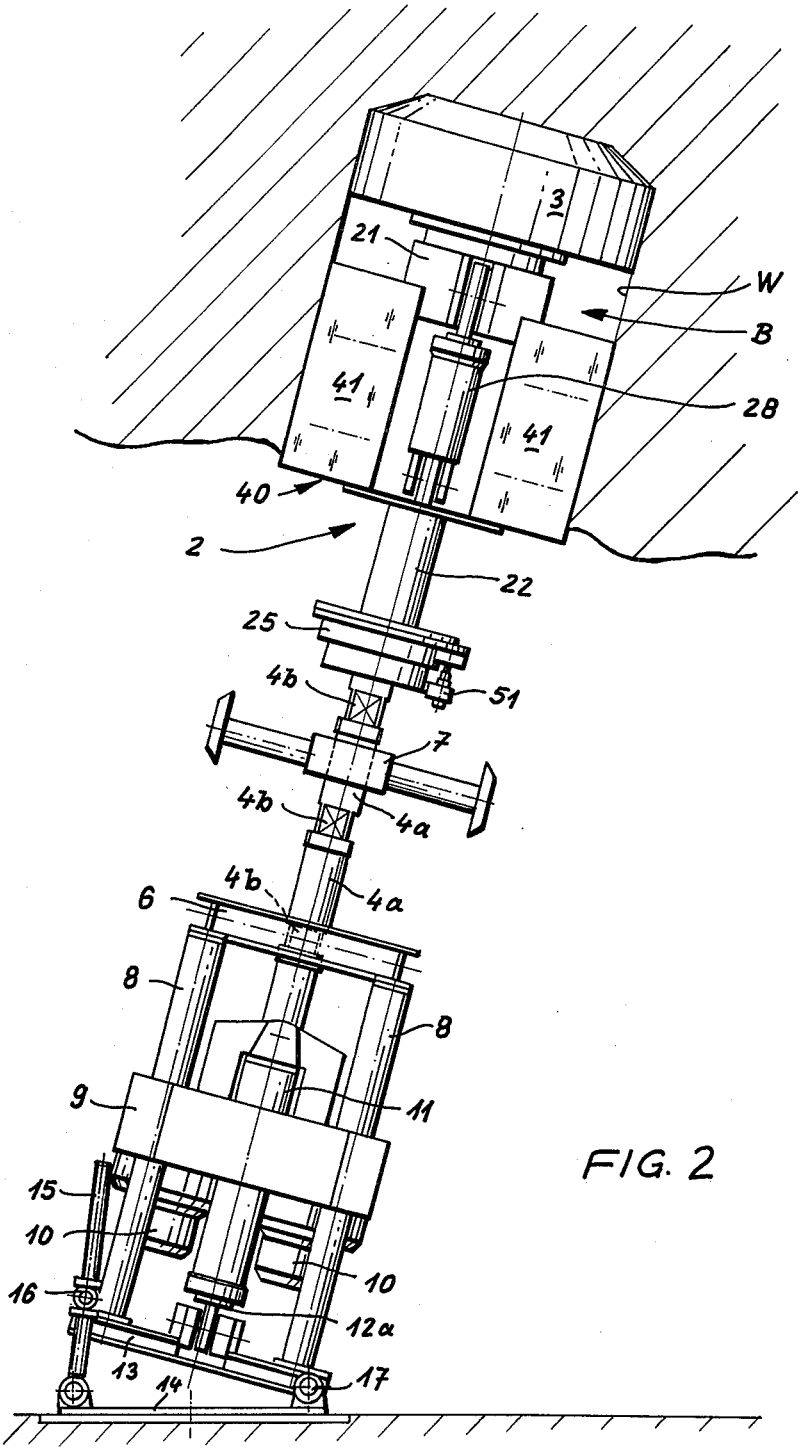
FIG. 2 illustrates the apparatus shown in FIG. 1 in a working position.
Figure 5:
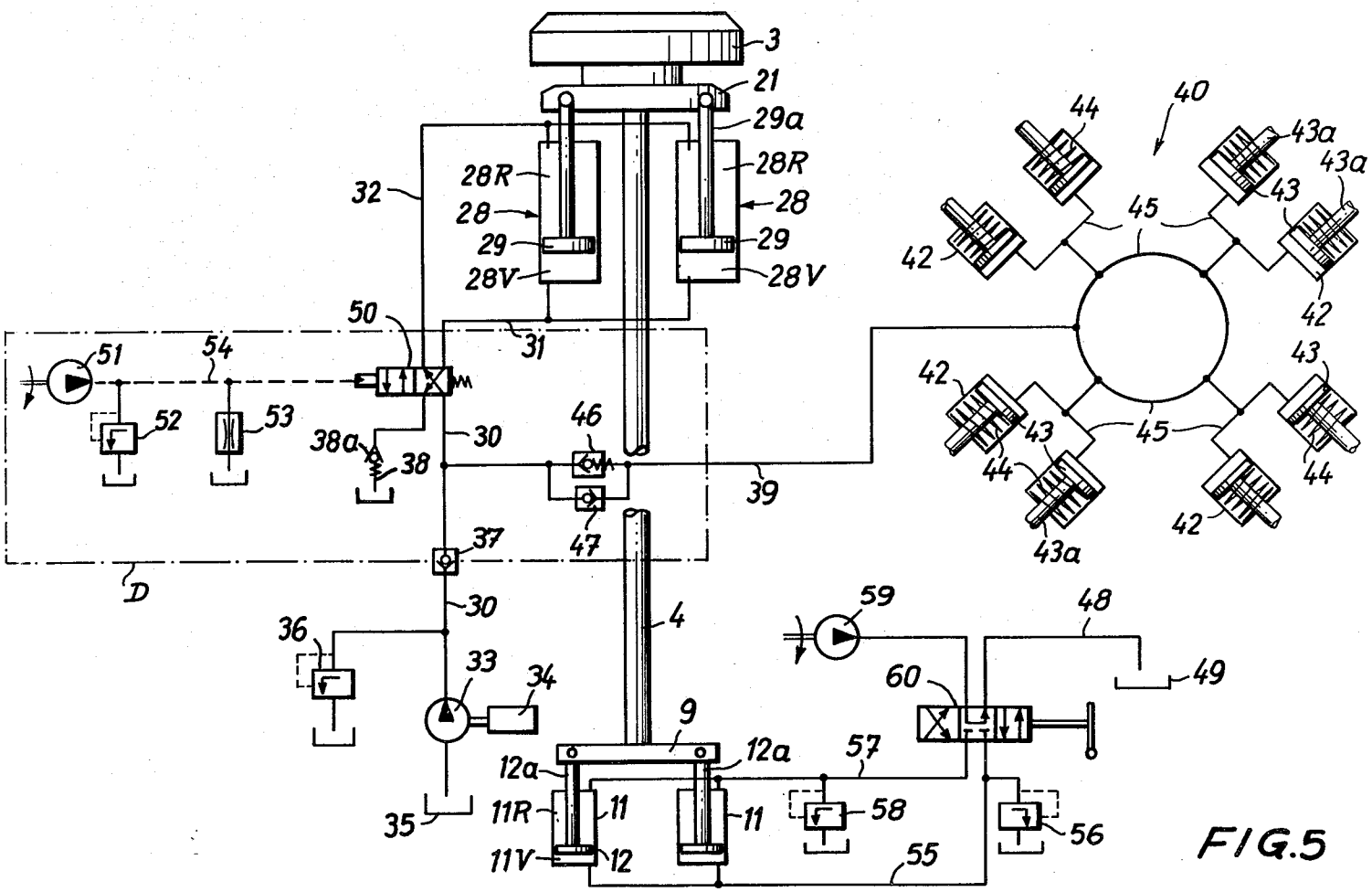
FIGS. 5 and 6 are pressure medium circuit diagrams, and illustrate different operating conditions of the pressure medium circuit.
Figure 6:
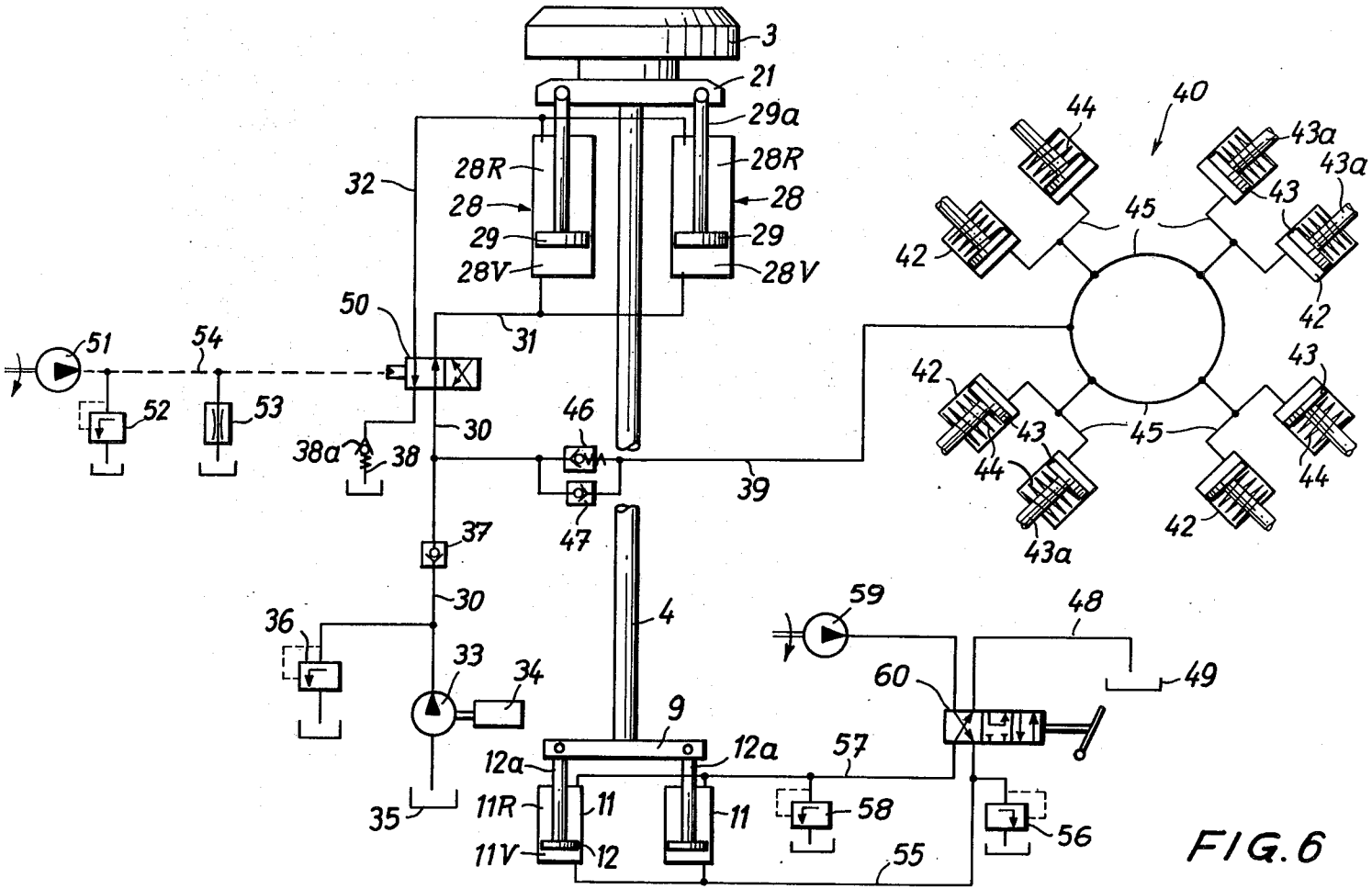

The apparatus shown in the drawings comprises a basic unit 1, which can be assembled underground in a roadway, starting chamber or the like, a driving or heading part 2, which forms a drill hole B and is provided with a drilling head 3, and a train 4 of rods, which connect the driving part 2 to the basic unit 1 (FIGS. 2,5,6). This train of rods 4 consists of a number of rod sections 4*a* (FIG. 2), which are in particular in the form of tubes and are screwed together, by means of screw-threads, at their ends analogously to the technique used with a train of rods used in deep drilling; the individual rod sections 4*a* may alternatively be releasably attached to one another in some other way. The inside of the train 4 of rods forms a continuous hollow space serving as conveyance path for a fluid pressure medium, which is used for supplying elements of the driving part 2 and is introduced into the train 4 of rods in a manner known per se and by way of a rotary guide means provided in the basic unit 1. The fluid pressure medium is delivered by a pressure medium force, which is not shown in FIGS. 1 and 2 and is preferably constituted by a pump, and introduced by way of a hose 5 or the like (FIG. 1). Other working units and energy supply units used in the apparatus are not shown in FIGS. 1 and 2. Feed working units and energy supply units may, together with an operating platform, be mounted beside or in the vicinity of the basic unit 1 in a starting chamber.

At their ends the rod sections 4*a* are each provided with a square surface 4*b* (FIG. 2) which are engaged by members, installed in the head part 6 of the basic unit 1, of an apparatus which functions in accordance with a known principle and serves to support, break and add or dismantle individual rod sections, when the train 4 of rods is to be extended, so as to accord with the drilling progress made, or is to be dismantled at the end of drilling work. According to particular requirements one or more rod sections 4*a* may be equipped with a stabilizer 7, which comprises a rotary bearing and supporting arms or the like, such as is shown in FIG. 2. If, in addition to the working medium for elements of the driving part 2, a further medium is to be led into the area of the driving part or to the drilling station, this further medium being for example required for cooling purposes, for washing (flushing), or for the settling of dust, use may be made of a train of double-walled rods or of a train of rods having more than two ducting paths.

The basic unit 1, which may fo example be in the form of a frame structure, comprises a lifting slide 9, which is guided on columns 8 and on which are located two or four drive motors 10, which are in particular in the form of hydraulic motors and the speed of which is preferably variable, these drive motors 10 possibly being reversible in their running direction. The drive motors 10 transmit their torque, e.g. by way of gear-wheels, to a central driving part, which lockingly receives the lower end of the train 4 of rods or comprises a coupling member for the momentarily lowest rod section, the arrangement being such that the train 4 of rods can be driven by the motors 10 so as to rotate at speeds which vary according to particular circumstances.

Two supporting cylinders 11 are rigidly attached to the lifting slide 9, the piston rod 12*a* of the pistons 12 which are slidable in the supporting cylinders 11 and can be acted on, at both their ends, by fluid pressure medium conveyed by ducts which are not shown in FIGS. 1 and 2, being articulated to the lower frame part 13 of the basic unit. FIGS. 5 and 6 illustrate two reverse ways of routing the fluid pressure medium. Thus, by means of the supporting cylinders 11, the lifting slide 9, and consequently the train 4 of rods which extend upwardly from the lifting slide 9, can, when drilling is taking place, when rod sections are being added or dismantled, or on other occasions, be moved up and down, or be loaded in one or the other direction subject to a required force, or be held stationary.

The basic unit 1 may be assembled vertically or at an angle relative to the vertical. FIGS. 1 and 2 illustrate the situation in which the basic unit 1 lies at an angle to the vertical; the position of obliquity may be assumed and maintained by means of screw-threaded spindles 15 which engage a baseplate 14 and with which mesh nuts 16 which are articulated to the lower frame part 13. A pin or journal bearing 17 is provided about which the basic unit or the whole apparatus can be swivelled. An erector device 18 (FIG. 1) may be used as an auxiliary means for mounting the apparatus, this erector device 18 being capable of being articulated to the pin 17 of the basic unit and comprising a support 19 for the driving or heading part 2 and one or more erecting cylinders 20.

The drilling head 3 of the driving part 2 may be constructed in a manner appropriate to the particular practical application in question, and be provided with suitable tools, in particular with roller bits, disc or stud (wart) rollers or the like. There may be provided, on the drilling head or additionally to the latter, a projecting part for extension, together with a tool, for producing a smaller, leading drill hole. A bearing housing 21 contains the rotary bearing of the drilling head 3 and, accordingly, does not itself rotate. Rigidly attached to this bearing housing is a supporting body 22 (cf. FIGS. 3 and 4 in particular), which is shaped on its outside as a polygon, e.g. a square, a tube or hollow shaft 24 passing through the inside of this supporting body 22 and forming a continuation of the train 4 of rods. This tube or hollow shaft 24 is connected to the drilling head 3 and, at its lower end, has a conical screw-threaded part 23 which is intended to mate with a rod section 4*a* which lies adjacent the part 23 and is of complimentary shape to the latter. The supporting body 22 ends in a housing 25, which may contain a rotary guide means for guiding fluid pressure medium and also parts which belong to a fluid pressure medium system, for example those components which lie within the area delineated by the chain dotted lines D.

Slidably arranged on the supporting body 22 is a slide 26, a housing 27 of which surrounds the polygonal portion of the supporting body 22 and is of complementary shape to the latter. Two feed cylinders 28 lie to either side of the center axis M of the apparatus (only one of these feed cylinders is shown in each of FIGS. 3 and 4), the lower ends of which cylinders are articulated to the slide 26, while the upper ends of piston rods 29*a* of pistons 29 which are slidable within the feed cylinders 28 are articulated to the bearing housing 21. A fluid pressure medium duct 32 leads to annular spaces 28R of the feed cylinders 28, and a fluid pressure medium duct 31 leads to full (unencumbered) spaces 28V of the cylinders 28.

Further, the slide 26 is equipped with a clamping unit 40, which comprises four (for example) plates 41 which can be pressed against the wall W (see FIG. 2) of the drill hole and withdrawn from this wall W. As is clear both from FIGS. 3 and 4, and also from FIGS. 5 and 6, two clamping cylinders 42, together with their associated pistons 43, are allotted to each plate 41, the piston rods 43*a* of the pistons 43 carrying the clamping plate 41. The cylinders 42 contain compression springs 44 which act on the annular surfaces of the pistons 43, and thus bias the pistons, together with their associated clamping plates, radially inwardly. The full (i.e. unencumbered) surfaces of the pistons 43 can be acted on, by way of ducts 45, with fluid pressure medium for the purpose of outwardly moving the clamping plates 41 in opposition to the biassing force of the springs 44. In the clamping position the unit 40 forms, together with the slide 26, a counterabutment for the feed cylinders 28.

Figure 3:
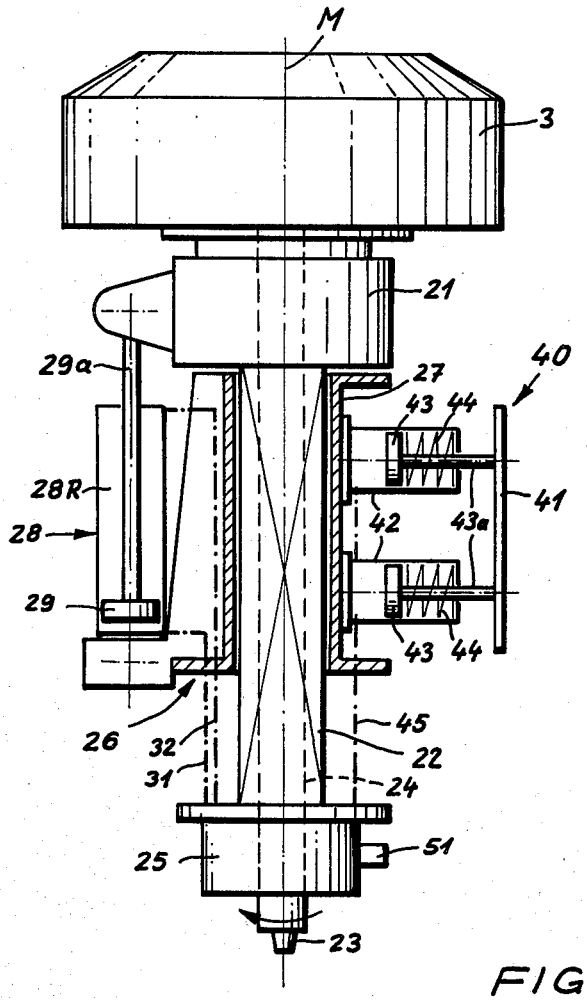
FIGS. 3 and 4 are partially diagrammatic, partially cross-sectioned, views of part of the apparatus operating in the drill hole, in two different positions of the feed apparatus.
Figure 4:
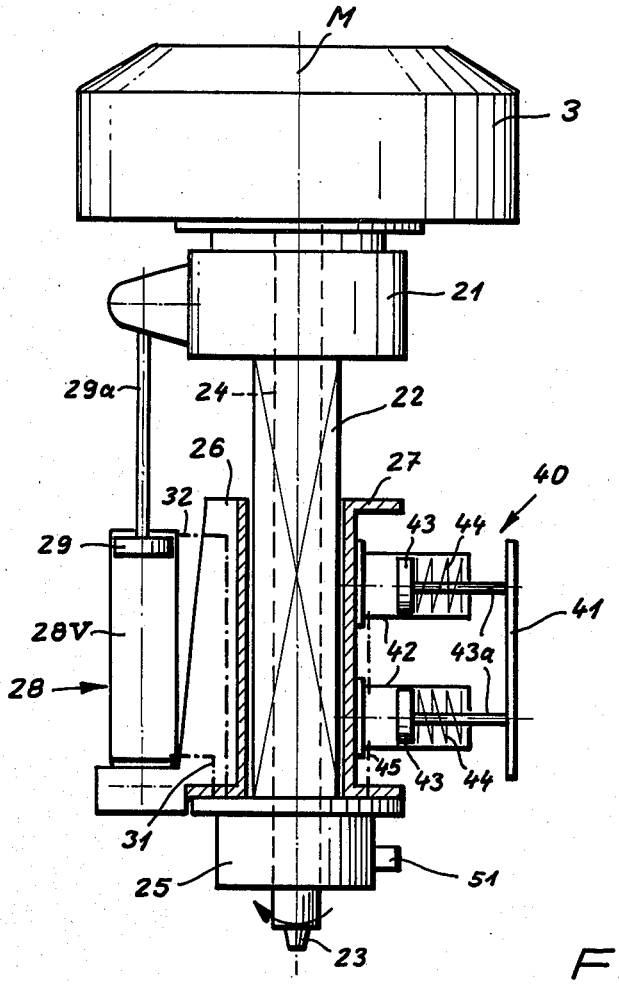

The arrangement is such that the slide 26 and the supporting body 22 can be moved, relative to each other, from the position shown in FIG. 3 into the position shown in FIG. 4; in particular, when the plates 41 are in pressing contact with the wall W of the drill hole, this corresponds to a drilling stroke accompanied by an advancing or feeding force, whereas the movement from the position shown in FIG. 4 into the position shown in FIG. 3 enables the clamping unit to recover its position, the drilling head 3 remaining in its position and the clamping plates 41 being released.

Actuation of the feed cylinders 28 and of the clamping cylinders 42 of the clamping unit 40 may take place through separate fluid pressure medium ducts or systems, suitable control and/or switching elements being provided on the basic unit 1 or upon a control platform adjacent the latter. However, it is particularly advantageous if a fluid pressure medium system fed from a common pressure medium supply duct is provided for the clamping unit 40 and for the feed cylinders 28. FIGS. 5 and 6 illustrate such a suitable common fluid pressure medium system. The pressure medium used is preferably water or a liquid having an aqueous basis.

The pressure medium system contains a main pump 33 which is drivable by a motor 34 and conveys water from a tank 35 into a common pressure medium supply duct 30. A large part of this duct 30 is constituted by the internal space of the train 4 of rods. In the circuit diagram of FIGS. 5 and 6 the duct 30 has been shown, purely for the sake of clarity, separate from the train 4 of drilling rods, the presence of which is roughly indicated in these two Figures. The required water pressure can be set in a valve 36, which also serves as a safety valve for the pump 33. The various elements are, for example, accommodated in an operating and supply unit associated with the basic unit 1. At least one one-way valve 37 is arranged in the duct 30. Each drilling rod section 4*a* preferably comprises such a one-way valve 37.

A control valve 50, acting as a directional control valve, is provided in that branch of the pressure medium system which contains the ducts 31 and 32 which lead to the feed cylinders 28. By means of the directional control valve 50, communication can be established between the annular spaces 28R of the feed cylinders 28 or the full spaces 28V of the cylinders 28 and the pressure medium supply duct 30 while the (at the appropriate time) other spaces 28V or 28R are freed so as to enable pressure medium to flow to a drain or discharge means 38 (this may be in the form of a receiving container, or the pressure medium may discharge directly into a drill hole). Conveniently, a valve 38*a* may be provided which is subject to a small biassing force.

In the embodiment illustrated the control valve 50 is held in, or brought into, the position shown in FIG. 5 by a restoring spring or the like, while the position shown in FIG. 6 is attained by hydraulic actuation. For this purpose use is made of a control pump 51 which conveys pressure medium into a duct 54; this control pump 51 may, together with a container for hydraulic oil or the like, lie in or on the housing 25 at the lower end of the supporting body 22 (cf.FIGS. 3 and 4) and be driven by the rotation of the train 4 of drilling rods. Thus, the control pump 51 only functions when the drilling head 3 is rotating. There are also provided a safety valve 52 for the control pump 51 and a choke 53 or the like; the choke 53 permits a specified flowthrough of pressure medium so as to reduce the pressure when the pump has ceased to operate.

A counterpressure valve 46, e.g. a spring-loaded one-way valve, is provided in a duct section 39 leading from the pressure medium supply duct 30 to the cylinders 42 of the clamping unit 40, and a simple one-way valve 47, having a flow direction opposite to that of the counterpressure valve 46, is arranged in parallel with the counterpressure valve 46. The counterpressure valve 46 may for example be set to a counterpressure of 10 or 15 bar.

The supply of fluid to, and control of, the cylinders 11, present in the basic unit 1, may take place in various ways. FIGS. 5 and 6 also show a convenient and simple layout for this. The system illustrated comprises a duct 57, leading to the annular spaces 11R of the supporting cylinders 11, together with a pressure adjustment valve 58 in a branch duct leading from duct 57, and also a duct 55 leading to the full (i.e. unencumbered) spaces 11V of the supporting cylinders 11, together with a pressure adjustment valve 56 positioned in a duct branching off from the duct 55. There are also provided a control valve 60, which is constituted as a 4/3-way valve and is actuated by hand, by remote control, automatically, or is programme-controlled, and a discharge duct 48. A pump 59 and a tank 49 for hydraulic oil or the like also belong to this system.

A description now follows of one of a number of possible working procedures for producing a drilling using the apparatus and the pressure medium system as described above.

It is to be assumed that the slide 26 lies, together with the clamping unit 40, in a starting position, or has been brought back to this starting position, so that the drilling may now take place. The control valve 60 for the supporting cylinders 11 is, for example, in a central, blocking position. When the drive 10 for the drilling head 3 is switched on, the control pump 51 starts to function, and brings the control valve 50 into the position shown in FIG. 6. The main pump 33 is also switched on, so that this pump conveys water to the full spaces 28V of the feed cylinders 28, with the result that the full surfaces of the pistons 29 are acted on by the pressure medium. Because the drilling head abuts against the working face (cf. FIG. 2), the pressure rises in the cylinder spaces 28V, with the result that the counterpressure valve 46 opens, and fluid pressure medium acts on the pistons 43 of the clamping cylinders 42 with a corresponding pressure, this pressure being somewhat less than the pressure effective in the cylinder spaces of the feed cylinders 28. In this way the clamping plates 41 are firmly pressed against the drill hole wall W. The drilling head can then start to operate, and is forwardly pressed by the feed cylinders 28. The feeding force, can, by altering the pressure of the water conveyed in the system, be selected so as to correspond to prevailing conditions; in particular, the selection of this feeding force takes place by adjustment of the valve 36. As the control valve 60 has previously been brought into that position in which the lower cylinder spaces 11V are supplied with fluid pressure medium, the pistons 12 of these cylinders, acting on the lifting slide 9, follow the feed movement. The pressure can be adjusted, by means of the valve 56 to the required value, particularly in such a way that, during this movement, a certain proportion of the weight of the train 4 of rods, and of the parts moving with this train of rods in the drill hole, is carried by the supporting cylinders 11, e.g. a component of two thirds, while the remaining components, and also the feeding force itself, is applied by the feed cylinders 28. Thus, by adjusting the pressure in the upper and lower systems, or by adjusting the valves concerned, account can be taken of all requirements arising in practice.

If, in exceptional circumstances, the drilling head did not firmly abut against the working face at the commencement of drilling, the above described ascent will only take place, and the clamping unit 40 will only come into operation, subject to some delay. If desired, the supporting body 22 may, together with the train of rods 4, be temporarily prevented from executing a forward movement through the control valve 60 initially remaining in the central, blocking position, or being brought into this central, blocking position, until at the correct time pressure medium is fed to the pistons of the supporting cylinders 11 through a switching action of the valve 60. It is possible, by altering the manner of operation of the supporting cylinders 11 by means of the above-described hydraulic elements, or by means of other or additional control members to produce, even during the drilling process, conditions which are particularly favourable for this drilling process.

The main pump 33 is switched off at the end of the drilling stroke, a static pressure remaining in the system due to the one-way valve 37, and the rotary drive 10 is switched off. This causes the control pump 51 to cease to convey pressure medium, with the result that the control valve 50 is turned to the position shown in FIG. 5. In this way the cylinder spaces of the clamping unit 40 are connected, by way of the one-way valve 47 which opens in this direction, to the annular spaces 28R of the feed cylinders 28. Because the full surfaces of the pistons 29 in these cylinders are allowed, by way of valve 38*a*, to almost completely discharge to the drain 38, the train 4 of drilling rods and the supporting body 22 can drop slightly, relative to the slide 26, under to their own weight. Accordingly, by reason of the incompressability of the water, there is an immediate, complete decay in pressure, so that the clamping plates 41 are released from the drill hole wall W by the springs 44 in the clamping cylinders 42, the springs 44 pressing the pistons 43 of these cylinders radially inwardly. As a result of this a part of the water can be urged from these cylinders and by way of the one-way valve 47 into the annular spaces 28R of the feed cylinders 28. When the main pump 33 and the rotary drive 10 are switched off, the supporting cylinders 11 can, additionally, be so acted on, possibly through valve 60 switching into the blocking position (while the effectiveness of the valve 56 remains), so that discontinuation of the clamping effect is further accelerated.

Another method of discontinuing the pressure is also possible, this other method consisting in providing, in the duct 32, a valve which is adjustable to a predetermined opening pressure, possibly in such a way that this valve can only become effective for a relieving procedure.

After discontinuation of the clamping effect of the clamping unit 40, water is conveyed to the annular spaces 28R of the feed cylinders 28 by once again switching on the main pump 33, so that the slide 26 recovers, together with the clamping unit 40, its upwardly situated position relative to the supporting body 22, and in this way is brought into a new, starting position (cf. FIG. 3). By suitably controlling these supporting cylinders 11 or by means of the device contained in the head part 6 of the basic unit 1, the train 4 of drilling rods can be supported, whereupon the supporting cylinders 11 are, together with the lifting slide 9, lowered, and a new rod section 4a is installed. After this procedure, or overlapping with it, the slide 26 can again be clamped in the drill hole, and continuation of drilling can continue in the above described way.

The pressure medium system associated with the supporting cylinders 11 may also contain other than the above described or additional elements. The loading or movements of the train 4 of drilling rods, together with the associated components, can be effected in various ways so that the basic steps of the working procedure can be carried out as described above.

The apparatus according to the invention can be equipped with a control means which enables the drilling direction to be altered. For this purpose use can be made of means which are known per se.

We claim:

1. A method of producing a drill hole by full profile drilling in the upward direction utilizing a rotatable and displaceable drilling tool and a train of drilling rods connected at the lower end to a rotating drive device and leading to the drilling tool at the upper end, comprising applying a first fluid pressure force to said drilling tool in the feed direction thereof from the lower end of and through the train of drilling rods, applying a second fluid pressure force in said feed direction to said drilling tool through a second force applier in the vicinity of the upper end of said train of drilling rods, dividing said second fluid pressure and feeding a part thereof to a clamping unit to thereby releasably clamp said second force applier in the drill hole, and regulating said part of said fluid pressure applied to said clamping unit so that when said second fluid pressure force at the drilling tool reaches a predetermined amount, said part of said second fluid pressure fed to the clamping unit actuates said clamping unit to clamp said second force applier, and when said second fluid pressure force at the drilling tool is below said predetermined amount said clamping unit is released.

2. The method as claimed in claim 1 and further comprising controlling said second fluid pressure so that it automatically ceases to be applied to said drilling head in the feed direction when the rotating drive device is stopped.

3. Apparatus for producing an underground drill hole by full profile drilling comprising a base member adapted to be supported below the hole to be drilled, first feed means mounted on said base member for producing an upwardly directly feeding force, rotary drive means, a train of drilling rods comprised of a plurality of interconnectable parts extending upwardly and operably engaging at the lower end said first feed means and said rotary drive means so that said train of drilling rods can be rotated and displaced upwardly thereby, a drilling head operably engaging the upper end of said train of drilling rods to be rotatably driven and displaced upwardly thereby, a bearing housing rotatably mounted on said drilling head, and second feed means comprising a supporting body attached to said bearing housing, said train of drilling rods extending rotatably through said supporting body, a slide member non-rotatably and slidably mounted on said support member for guided movement in the direction of feed of said drill head, a clamping unit mounted on said slide member comprising fluid pressure operated clamping means for releasably clamping said slide member to the wall of the drill hole, double-acting fluid pressure operated piston and cylinder feed means connected at one end to said bearing housing and at the other end to said slide member to displace said members with respect to each other, a source of fluid pressure, and means to operably connect said fluid pressure source to said piston and cylinder means and to said fluid pressure operated clamping means.

4. Apparatus according to claim 3, wherein said slide member comprises a tubular housing which surrounds said supporting body.

5. Apparatus according to claim 3, wherein said clamping unit comprises a plurality of fluid pressure operated pistons and cylinder units, clamping plates connected to said piston and cylinder units so that they can be brought into abutment with the wall of the drill hole thereby, and spring means to retract said clamping plates.

6. Apparatus according to claim 3 wherein for the purpose of actuating said double-acting piston and cylinder means and said clamping unit, said means to connect said fluid pressure source comprises a pressure medium system which is fed from a common pressure medium supply duct.

7. Apparatus according to claim 6, wherein said common supply duct is guided through the train of drilling rods.

8. Apparatus according to claim 7, wherein at least one of said parts which form said train of drilling rods contains a one-way valve.

9. Apparatus according to claim 6, wherein said common supply duct is constituted by the train of drilling rods.

10. Apparatus according to claim 6, wherein said common supply duct contains at least one one-way valve which opens in the direction of said piston and cylinder means and said clamping means.

11. Apparatus according to claim 6 and further comprising means for regulating the pressure of the pressure medium in said common supply duct.

12. Apparatus according to claim 6, and further comprising a control valve provided in a part of said pressure medium system which is associated with said second double-acting feed cylinders to alternately connect the pressure medium supply duct to said cylinders on opposite sides of the pistons thereof and the corresponding other sides to a discharge means.

13. Apparatus according to claim 12, wherein said control valve is remotely actuated by said rotary drive means.

14. Apparatus according to claim 13, wherein said control valve comprises a pressure medium actuated directional control valve and a resilient force return means, and further comprising a control pump for producing said pressure medium to actuate said control valve, said control pump being operably connected to said rotary drive means to be controlled thereby.

15. Apparatus according to claim 6, and further comprising a branch duct interconnecting said common duct and said clamping unit, a counterpressure valve provided in said branch duct to supply said pressure medium to operate said clamping unit at a predetermined pressure and, in parallel with said counterpressure valve, a one-way valve having a direction of flow reverse to that of said counterpressure valve.

16. Apparatus according to claim 3, wherein said first feed means comprises supporting double-acting piston-cylinder units mounted at one end on said base member, first fluid pressure medium supply means operably connected to said supporting piston-cylinder units, and a lifting member operably connected to said supporting piston-cylinder units to be raised and lowered thereby, said rotory drive means being supported on said lifting member.

17. Apparatus according to claim 16, wherein said first fluid pressure medium supply means comprises a duct operably connected to said supporting cylinders on opposite sides of the pistons thereof, a first pressure medium supply source connected to said duct, and a control valve in said duct operable to selectively alternately connect said opposite sides of said piston to said first pressure medium supply source and the corresponding other sides to a discharge means.

18. Apparatus according to claim 17, wherein said control valve includes a blocking position for said duct.

19. Apparatus according to claim 17, including a pressure regulating means in said duct for regulating the pressure of the pressure medium in said duct.

* * * * *